US006315585B1

(12) United States Patent
Oka

(10) Patent No.: US 6,315,585 B1
(45) Date of Patent: Nov. 13, 2001

(54) LEVER-TYPE ELECTRICAL CONNECTOR

(75) Inventor: Hiroyuki Oka, Yokkaichi (JP)

(73) Assignee: Sumitomo Wiring Systems, Ltd., Mie (JP)

( * ) Notice: Subject to any disclaimer, the term of this patent is extended or adjusted under 35 U.S.C. 154(b) by 0 days.

(21) Appl. No.: 09/630,445

(22) Filed: Aug. 2, 2000

(30) Foreign Application Priority Data

Aug. 2, 1999 (JP) ..... 11-218777

(51) Int. Cl.[7] ..... H01R 13/62

(52) U.S. Cl. ..... 439/157; 439/488; 439/489; 439/923

(58) Field of Search ..... 439/157, 488, 439/489, 159, 152, 923

(56) References Cited

U.S. PATENT DOCUMENTS

| | | | |
|---|---|---|---|
| 5,201,670 | 4/1993 | Watanabe et al. | 439/372 |
| 5,230,635 | 7/1993 | Takenouchi et al. | 439/157 |
| 5,476,390 | 12/1995 | Taguchi et al. | 439/157 |
| 5,630,727 | 5/1997 | Kameyama | 439/352 |
| 6,120,308 * | 9/2000 | Hayashi | 439/157 |

FOREIGN PATENT DOCUMENTS 0 483 853 A2 5/1992 (EP) .

* cited by examiner

*Primary Examiner*—Paula Bradley
*Assistant Examiner*—Ann McCamey
(74) *Attorney, Agent, or Firm*—Oliff & Berridge, PLC

(57) ABSTRACT

A lever-type electrical connector has first and second connector housings adapted to be detachably fitted together in a connected position by relative movement in a fitting direction. A lever is rotatably mounted for drawing the connector housings towards said connected position. Locking means are provided on the connector housings for locking them together in the connected position. Springs act operatively between the connector housings to be compressed when the connector housings are being moved towards the connected position, thereby to create a force urging the connector housings in their separation direction at least during the movement of the connector housings towards the connected position. This reduces the risk of incomplete fitting together of the housings.

5 Claims, 19 Drawing Sheets

LEVER-TYPE ELECTRICAL CONNECTOR

BACKGROUND OF THE INVENTION

1. Field of the Invention

The present invention relates to a lever-type electrical connector, for example a connector suitable for use in a motor vehicle to connect wire bundles.

2. Description of the Related Art

It is necessary to connect multipolar electrical connector components to each other with a high fitting force. For this purpose a lever-type connector is employed. In a lever-type connector, for example, a lever having a cam groove is rotatably mounted on a male housing, and a follower fitting in the cam groove is provided on a mating female housing. When the two housings are fitted to each other, with the lever at an initial position, the follower enters the entrance of the cam groove. With rotation of the lever, the housings are drawn together, as the follower moving in the cam groove. The construction is intended to permit fitting of the housings to each other with a small applied force, utilizing the action of the lever. This type of lever-type connector is disclosed in JP-A-6-275337. A similar connector is disclosed in U.S. Pat. No. 5,476,390.

In the above-described lever-type connector, when the lever has rotated to its rotational termination, the two housings are normally fully fitted in each other. As the lever approaches its rotational termination, the fitting resistance becomes large, while the applied force remains low. Thus, there is a danger that the lever-rotating operation is stopped before the housings are fully fitted to each other. As a result, the housings are left in an incompletely fitted state. Further, even if the lever is rotated to its rotational termination, the housings may be left in an incompletely fitted state owing to an error in the manufacture of component parts of the housings. In either case, it may be very difficult for the operator to detect such incomplete fitting.

SUMMARY OF THE INVENTION

It is an object of the present invention to provide a lever-type connector permitting detection of whether the two connector housings have been normally fitted in each other.

With a view to achieving this object, according to the invention there is provided a lever-type electrical connector having first and second connector housings adapted to be detachably fitted together in a connected position by relative movement in a fitting direction, and a lever rotatably mounted on the connector for drawing the connector housings in said fitting direction towards said connected position. Locking means are provided on the connector housings for locking them together in the connected position. Spring means are provided to act operatively between the connector housings so as to be resiliently deformed when the connector housings are being moved towards the connected position, thereby to create a force urging the connector housings in their separation direction at least during the movement of the connector housings towards the connected position.

In this construction, to fit the two connector housings to each other, the lever is rotated. When the connector housings have achieved a normal connected or fitted state, the locking means holds the fitted state. If the fitting operation is stopped before the connector housings are in the normal fitted state, the urging force of the spring means causes the connector housings to separate from each other. Irrespective of the position of the lever therefore, it is possible to securely detect whether or not the connector housings have been fitted in each other normally.

Preferably the spring means comprises at least one spring having a front end and a rear end, the first connector housing acting upon the front end of the spring to compress it during fitting of the connector housings together, and the second connector housing has a spring holder restraining the rear end of the spring. In this embodiment, the spring holder is arranged to cooperate with the locking means so that, during fitting of the connector housings together, (i) before the locking means locks the connector housings in the connected position the spring holder restrains the spring from relaxation of its compressed state, and (ii) when the locking means has locked the connector housings in the connected position the locking means releases the restraint of the spring to allow at least partial relaxation of the spring. In this embodiment, when the connector housings are fitted to each other, the spring incorporated in the second connector housing is acted on by the first connector housing. At this time, the spring holder restrains the rear end of the spring. Thus, with the progress of the fitting operation, the spring is gradually compressed. Accordingly, if the fitting operation is stopped before the connector housings are fitted on each other normally, they are separated from each other by the spring force. The spring force is relaxed on normal fitting, and this may be detectable by the user.

Preferably the locking means comprises cooperating members in the form of at least one locking projection provided on the first connector housing and correspondingly at least one resiliently deformable locking arm provided on the second connector housing. The locking projection and locking arm are arranged and shaped so that, when the connector housings are moved towards the connected position, the locking arm engages and is deflected by the locking projection and thereafter locks behind the locking projection in a latch manner. The locking arm when so deflected prevents the spring holder releasing the compressed state of the spring. With the progress of the fit-in operation, the locking arm rides on the locking projection. When the housings have been fitted in each other, the locking arm returns to its original state by its elastic or resilient deformation and is locked to the locking projection. As a result, the connector housings are prevented from separating from each other. In association with this restoring operation of the locking arm, the spring holder releases the rear end of the spring. Thus, the spring is released from the compressed state. Accordingly, after the connector housings are fitted in each other normally, the spring force does not act as a connector separating force.

When the connector housings are long and narrow, there is a fear that they may be locked to each other with the longitudinal ends dislocated forward or rearward and inclining upward or downward. As a result, the connector housings may not be fitted normally on each other. Preferably, in this case, the locking means act to lock the connector housings together at both ends of the connector housings in their elongation direction and the spring means comprises springs likewise act on the housings at both their ends.

Preferably, one of the connector housings comprises a housing portion to receive electrical terminals and a casing which receives the housing portion, the housing portion being slidable in the casing in the direction of fitting of the connector housings to each other. The lever is rotatably mounted on the housing portion and has a cam surface, while the other connector housing has a cam follower which engages this cam surface during fitting of the connector housings together. The casing is engageable with the lever so that by its rotation the lever holds the casing and the housing portion together. The locking means and spring means are provided on, and act between, the casing and the other connector housing. With the connector housing portion accommodated in the casing located at the front side, this connector portion is fitted in the other connector housing. Then, the casing is pressed. As a result, the lever rotates. The connector housings are fitted to each other with a small force owing to the action of the lever. When they are normally fitted in each other, the casing is locked to the other connector housing, and the connector housings are held in a normal fitting state. If they are left in an incomplete state, the casing is pressed backward by the urging force of the spring means. This state is detected. In particular, the spring means is provided between the other housing and the casing. Thus, a small spring force is amplified by the lever to to separate the housings from each other. That is, it is possible to set the spring force to a low level.

BRIEF DESCRIPTION OF THE DRAWINGS

Embodiments of the invention will now be described by way of non-limitative example, with reference to the accompanying drawings, in which.

DETAILED DESCRIPTION OF THE PREFERRED EMBODIMENTS

Figure 1:
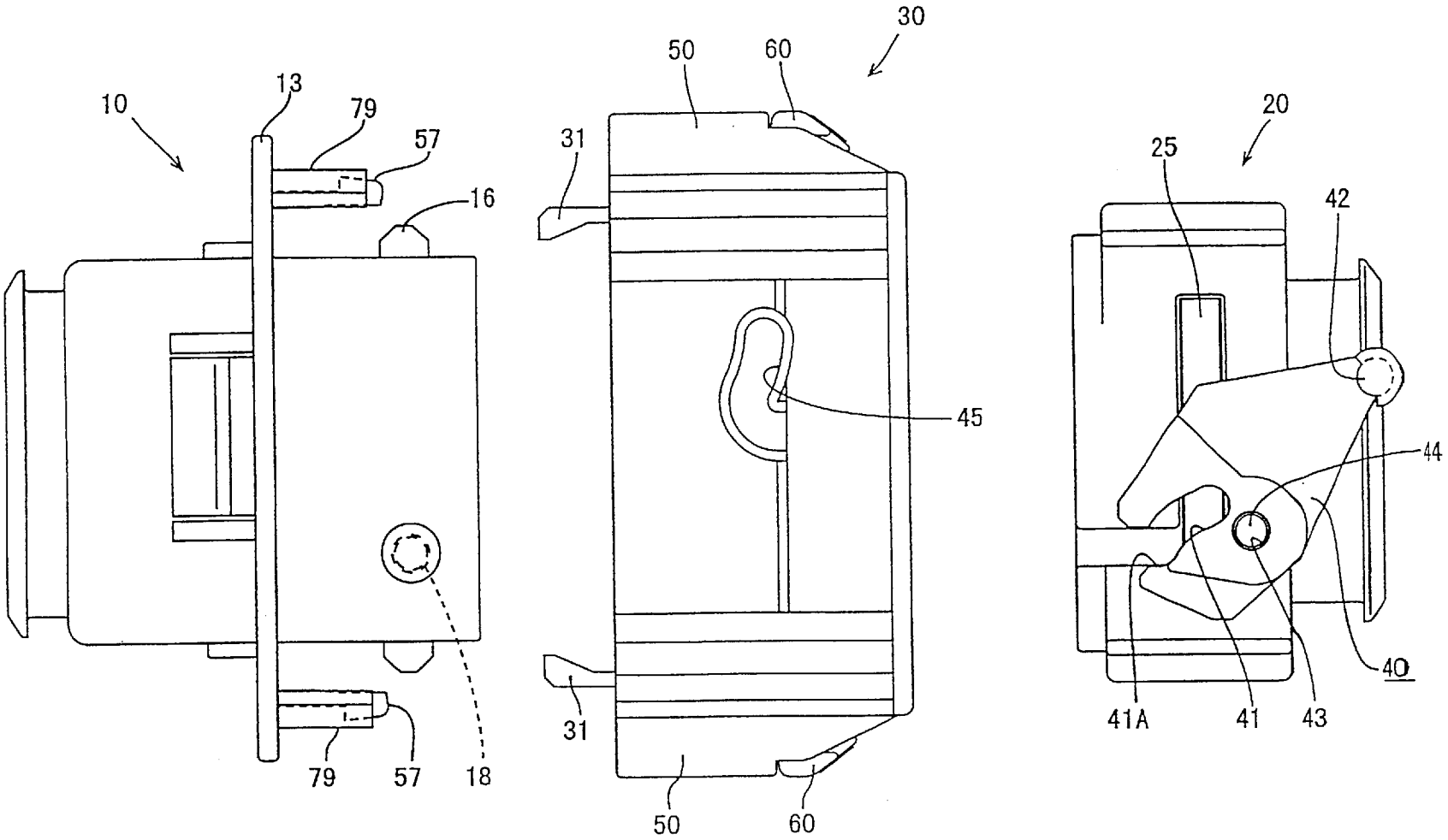
FIG. 1 is an exploded plan view of a connector which is an embodiment of the present invention.
Figure 2:
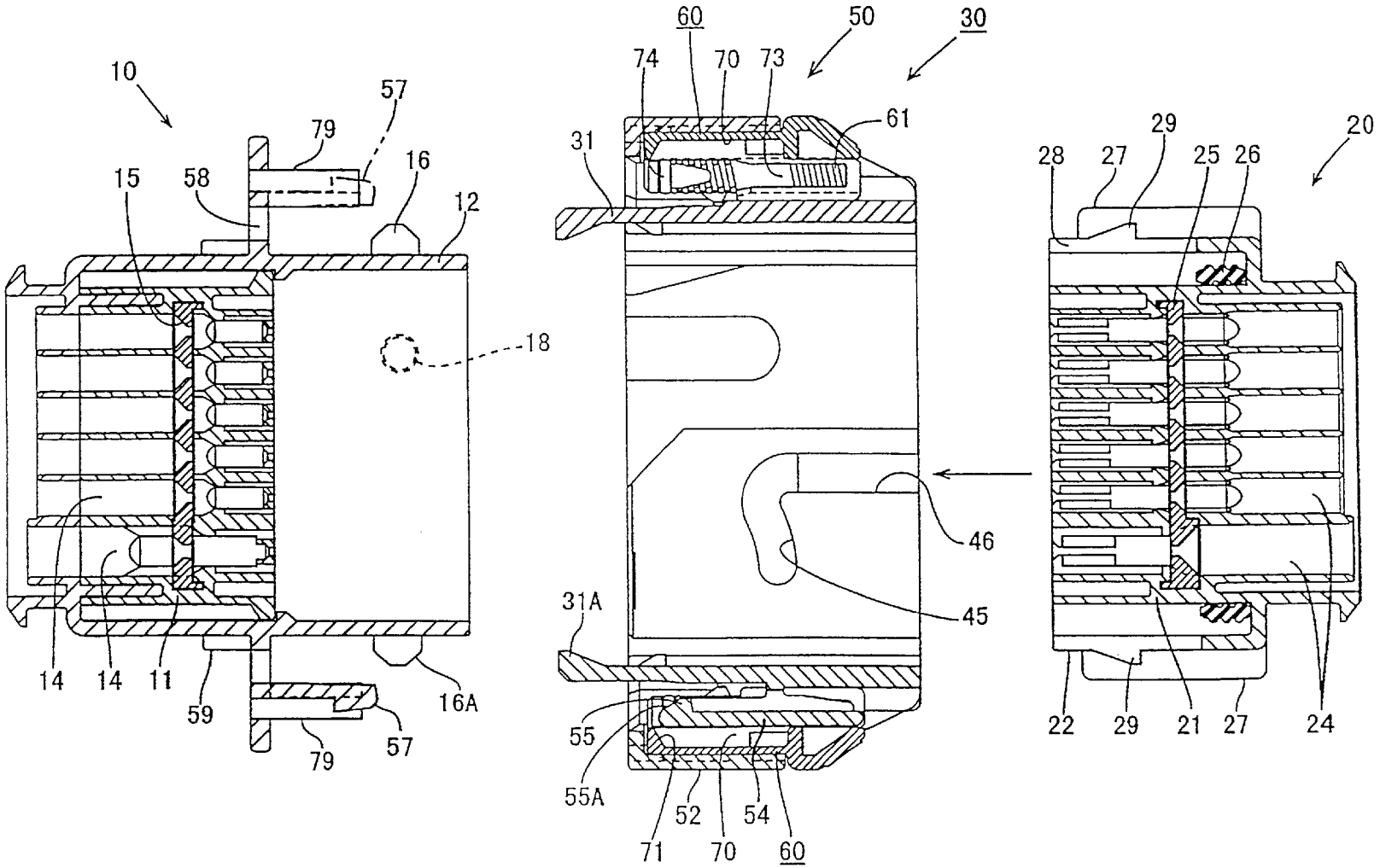
FIG. 2 is an exploded sectional view of the connector of FIG. 1.

A connector embodying the present invention is shown in FIGS. 1 to 22. As shown in FIGS. 1 and 2, the connector has a male-side connector housing 10 (hereinafter referred to as male housing 10) and a female-side connector housing portion 20 which, with the casing 30 described below forms a female housing of the connector. For convenience the portion 20 is called below the female housing 20 and is to be fitted in the male housing 10. In the description below, the side at which each of the male and female housings 10, 20 fit to each other is designated as the front side.

Figure 3:
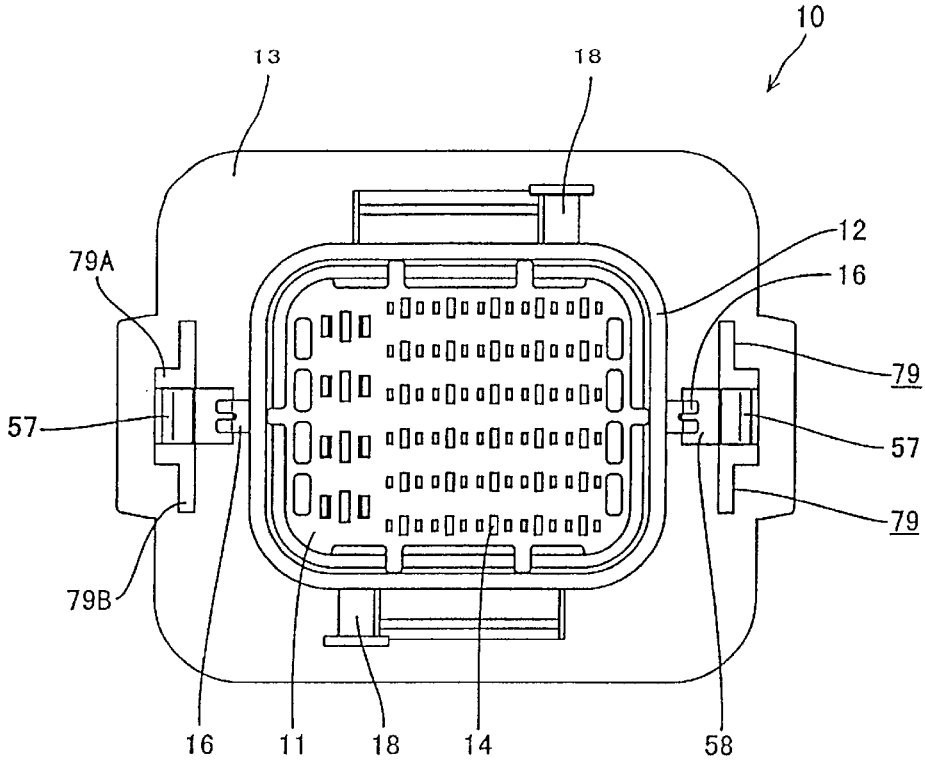
FIG. 3 is a front view of the a male housing of the connector of FIG. 1.

The male housing 10 is formed by combining two pieces made of synthetic resin material. As shown in FIG. 3, the male housing 10 has a body part 11 having an elongate width direction and generally rectangular. A small hood part 12 projects forward from the body part 11. An installing plate 13 for use when the connector is installed on a panel or the like (not shown) is formed at the base of the hood part 12.

An array of cavities 14 is formed in rows widthwise in the body part 11. Male terminal metal fittings (not shown) are inserted into respective cavities 14 from the rear side and held therein, with tabs thereof projecting into the hood part 12. The male terminal metal fittings are locked by retainers 15 to prevent their removal from the cavities 14.

The female housing 20 is also made of synthetic resin material. The female housing 20 has a body part 21 which can be received in the hood part 12 of the male housing 10 and a large hood part 22 which is located around the periphery of the body part 21 and can be fitted outside the smaller hood part 12. The large hood part 22 extends from a position a little rearward from the centre in a front-to-back direction of the female housing 20 to the plane of the front end surface of the body part 21.

An array of cavities 24 is formed in the female housing 20 in correspondence to the cavities of the male housing 10. Female terminal metal fittings (not shown) are inserted into respective cavities 24 from the rear side thereof, and locked by retainers 25 to prevent their removal from the cavities 24.

A seal ring 26 is fitted on the peripheral surface of the body part 21 of the female housing 20 at the base of the large hood part 22. In use the seal ring 26 is elastically sandwiched between the peripheral surface of the large hood part 22 and the front side of the small hood part 12 of the male housing 10.

Figure 5:
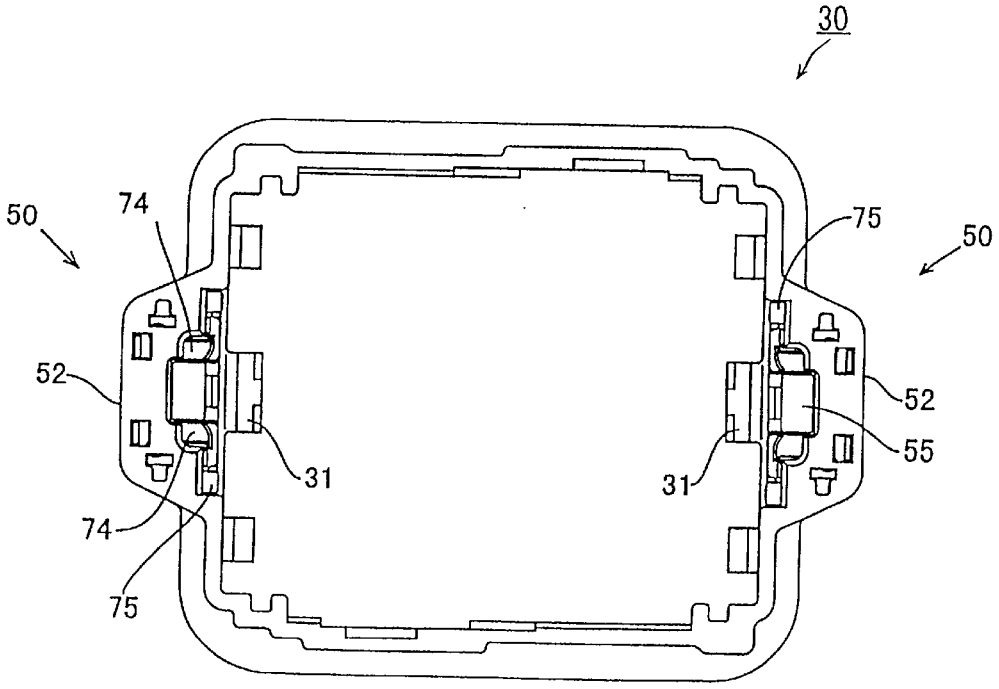
FIG. 5 is a front view of a casing of the connector of FIG. 1.
Figure 6:
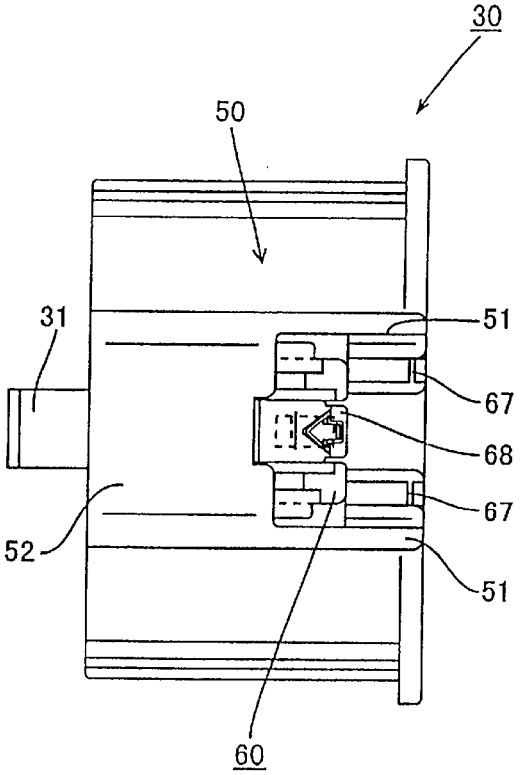
FIG. 6 is a side view of the casing of FIG. 5.

As shown in FIG. 5, the casing 30 also made of synthetic resin material is rectangularly cylindrical and is longitudinally slidable on the periphery of the female housing 20. A pair of cantilevered locking arms 31 project forward from the middle of the right and left inner side surfaces of the casing 30. As shown in FIG. 2, projections 31A are formed on the opposed surfaces of the locking arms 31 at their front ends. Each locking arm 31 is elastically deformable in the right-to-left direction so that the locking arms 31 may approach each other.

Figure 4:
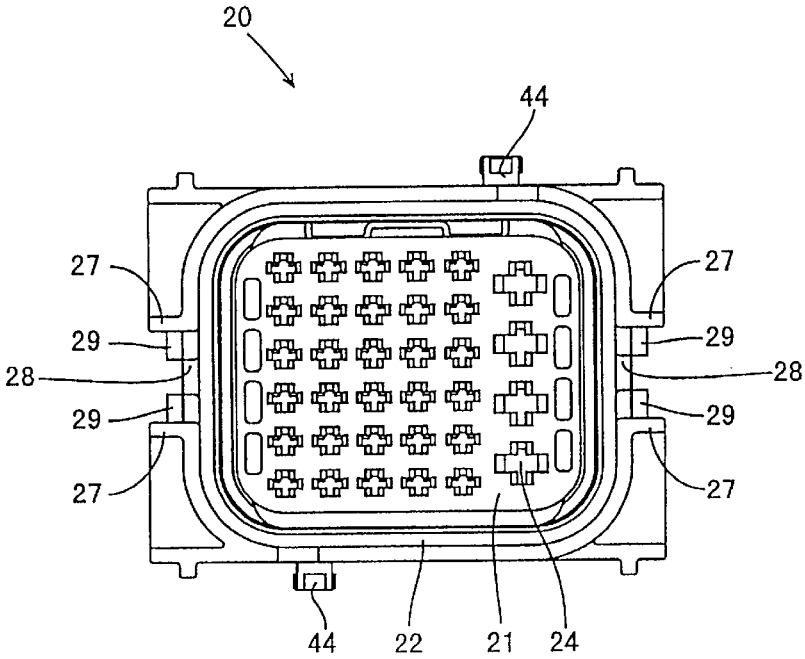
FIG. 4 is a front view of the female housing of the connector of FIG. 1.

As shown in FIG. 4, at the middle of each of right and left side surfaces of the large hood part 22 of the female housing 20, pair of guide rails 27 extends in the front-to-back direction. These rails slidably guide the respective locking arm 31, which becomes located between the guide rails 27. As shown in FIG. 2, an insertion groove 28 open forward is formed in the hood part 22 at the central portion between the guide rails 27. The groove 28 extends to a position at about the middle of the entire length of the guide rails 27 in the front-to-back direction. Near the front ends of the guide rails 27, a pair of locking portions 29 to be locked to the front end surface of the projection 31A of the locking arm 31 are formed on each side of the insertion groove 28. The pair of locking portions 29 can be locked to the projection 31A.

As shown by an arrow in FIG. 2, when the female housing 20 is inserted into the casing 30 from the rear thereof, the locking portions 29 strike the projections 31A so that the two locking arms 31 elastically deform outward. When the locking portions 29 pass the projections 31A, the locking arms 31 elastically deform inward, to be restored to their original state. The projections 31A thus lock against the rear surfaces of the locking portions 29, to prevent the female housing 20 being removed rearwardly from the casing 30.

Release projections 16 capable of penetrating into the insertion grooves 28 are formed at about the middle of the right and left outer side surfaces of the small hood part 12 of the male housing 10. A corner of each release projection 16 at its front end is formed as a tapered guide surface 16A. When the release projection 16 penetrates into the insertion groove 28 from the front side thereof, the guide surface 16A strikes the front end of the projection 31A, thus deforming the locking arm 31 elastically outward. As a result, the locking portion 29 is unlocked from the locking arm 31, and the female housing 20 is allowed to move rearwardly inside the casing 30.

A pair of levers 40 for assisting the fitting of the male housing 10 and the female housing 20 is symmetrically mounted on the upper and lower surfaces of the female housing 20. The two levers 40 are joined by a cross-bar (not shown) so that they move together in tandem. As shown in FIG. 1, each lever 40 is wide at a first end and tapered towards its other end. A curved driving cam slot or groove 41 is formed in the first end of the lever 40, with an entrance opening 41A at an edge of the lever. A pin 42 around which a flange partly extends stands up from the other side of the lever 40.

A bearing hole 43 is formed in the lever 40 near the inward end of the driving cam groove 41. A shaft 44 stands up on the upper surface of the large hood part 22 of the female housing 20 near the right (lower side in FIG. 1) end of the upper surface of the large hood part 22. The lever 40 is rotatably supported by fitting of the shaft 44 in the bearing hole 43. The other lever 40 is correspondingly fitted.

As shown in FIGS. 1 and 2, a cam groove 45 is formed on the upper surface of the casing 30, at one side (upper side in FIG. 1) from the widthwise centre of the upper surface of the casing 30. The operation pin 42 of the lever 40 can be fitted in the cam groove 45 slidably and without play. As shown in FIG. 2, a first part 46 providing an entrance of cam groove 45 extends in the insertion direction (arrow in FIG. 2) and its base part bends to extend slightly rearwardly and almost perpendicular to the first part.

Figure 10:
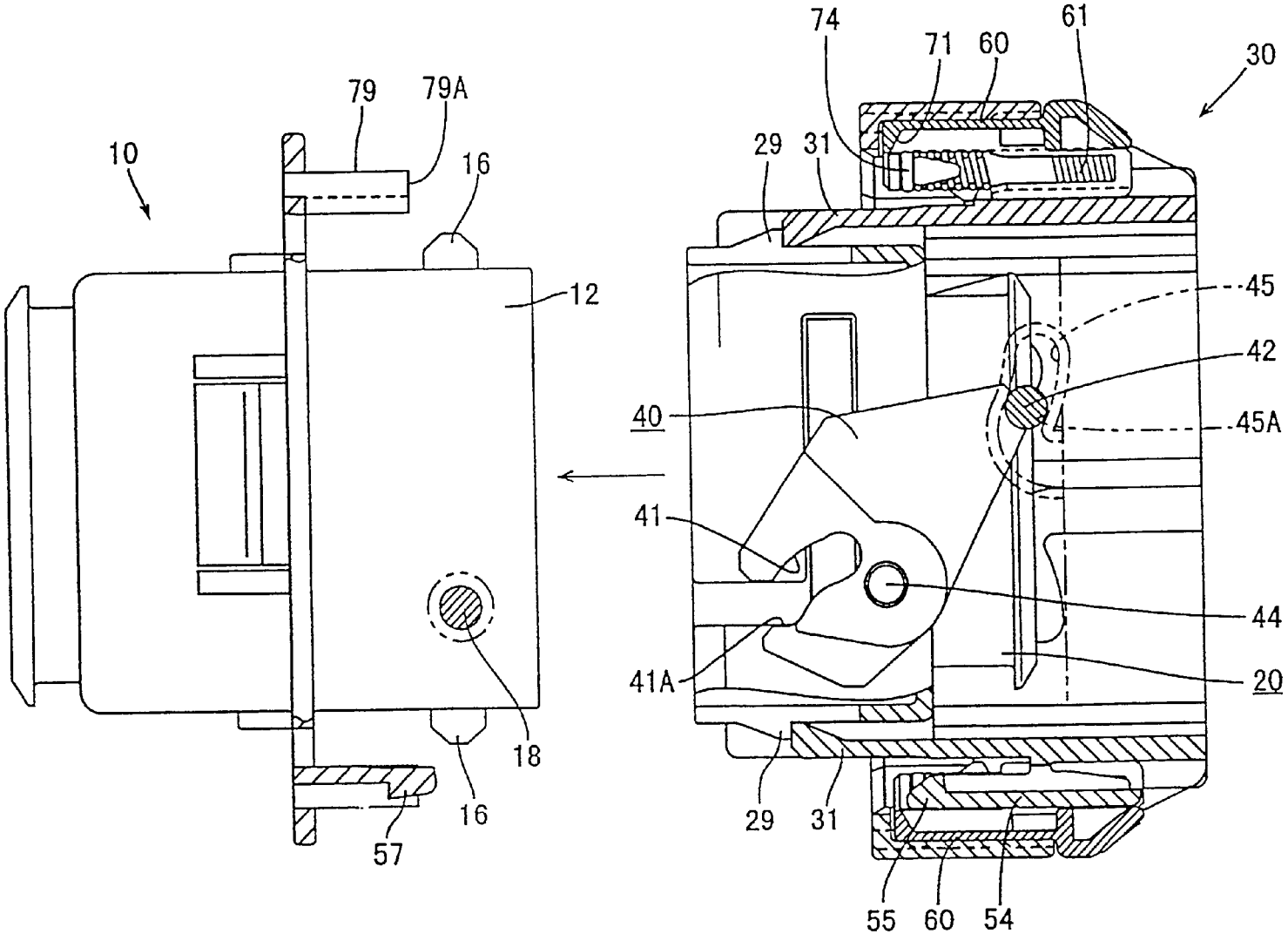
FIG. 10 is a partly cut-away plan view of the connector of FIG. 1 showing a state in which the housings have not been fitted in each other.

The operation pin 42 is introduced into the cam groove 45 through the entrance 46, with the lever 40 supported by the female housing 20. In this state, the female housing 20 is pressed into the position at which the locking arms 31 prevents the removal of the female housing 20 in the rearward direction. As a result, as shown in FIG. 10, the operation pin 42 is located at a start end 45A of the base part of cam groove 45, and the lever 40 is held so that the entrance 41A of its driving cam groove 41 faces forward.

A pair of follower pins 18 which can be fitted slidably without play in the two driving cam grooves 41 stand upwardly on the upper and lower surfaces respectively of the small hood part 12 of the male housing 10 at the same positions relative to the centre of the housing 10.

The male and female housings 10, 20, have locking means for locking them to each other in a normal fit-in state and a spring means for detecting whether the housings 10, 20 have been normally fitted in each other. The locking means and the spring means are described below.

An accommodation part 50 is provided at the middle region of the right and left side surfaces of the casing 30. The accommodation part 50 has a pair of spaced side walls 51 (see FIG. 6). Outwardly, the accommodation part 50 is covered by an arch portion 52.

As shown at the lower side of FIG. 2, each accommodation part 50 accommodates an elongate locking arm 54, connected at the inner surface of its centre portion in its longitudinal direction with the bottom surface of the accommodation part 50. The locking arm 54 is elastically deformable in a see-saw member on the connected point. About the half of the front portion of the locking arm 54 is located inside the arch portion 52. A hook-shaped locking claw 55 is formed at the front end of the locking arm 54. The front end surface of the locking claw 55 is formed as a tapered surface 55A.

A pair of right and left locking hooks 57 project forwardly from the installing plate 13 of the male housing 10 opposite the respective locking arms 54 of the casing 30. The locking hooks 57 are elastically deformable. Window holes 58 into which the locking arms 31 of the casing 30 can penetrate are formed in the plate 13 inwardly of the roots of the locking hooks 57. Receiving portions 59 are formed on the rear surface of plate next to the holes 58. When the locking arm 31 penetrates into the window hole 58 and engages the receiving portion 59 at its inner side, the locking hook 57 is prevented from deforming inward elastically.

Thus, when the casing 30 is fitted in the male housing 10, initially, the locking arm 31 penetrates into the window hole 58 along the inner side of the locking hook 57, thus preventing the inward elastic deformation of the locking hook 57. When the locking hook 57 strikes the tapered surface 55A, the locking arm 54 is pivoted. When the casing 30 has been inserted into a predetermined position on the male housing 10, the locking claw 55 becomes locked to the rear surface of the locking hook 57, with the locking arm 54 pivoting elastically back into its original state. In this manner, the removal of the casing 30 from the housing 10 is prevented.

Figure 7:
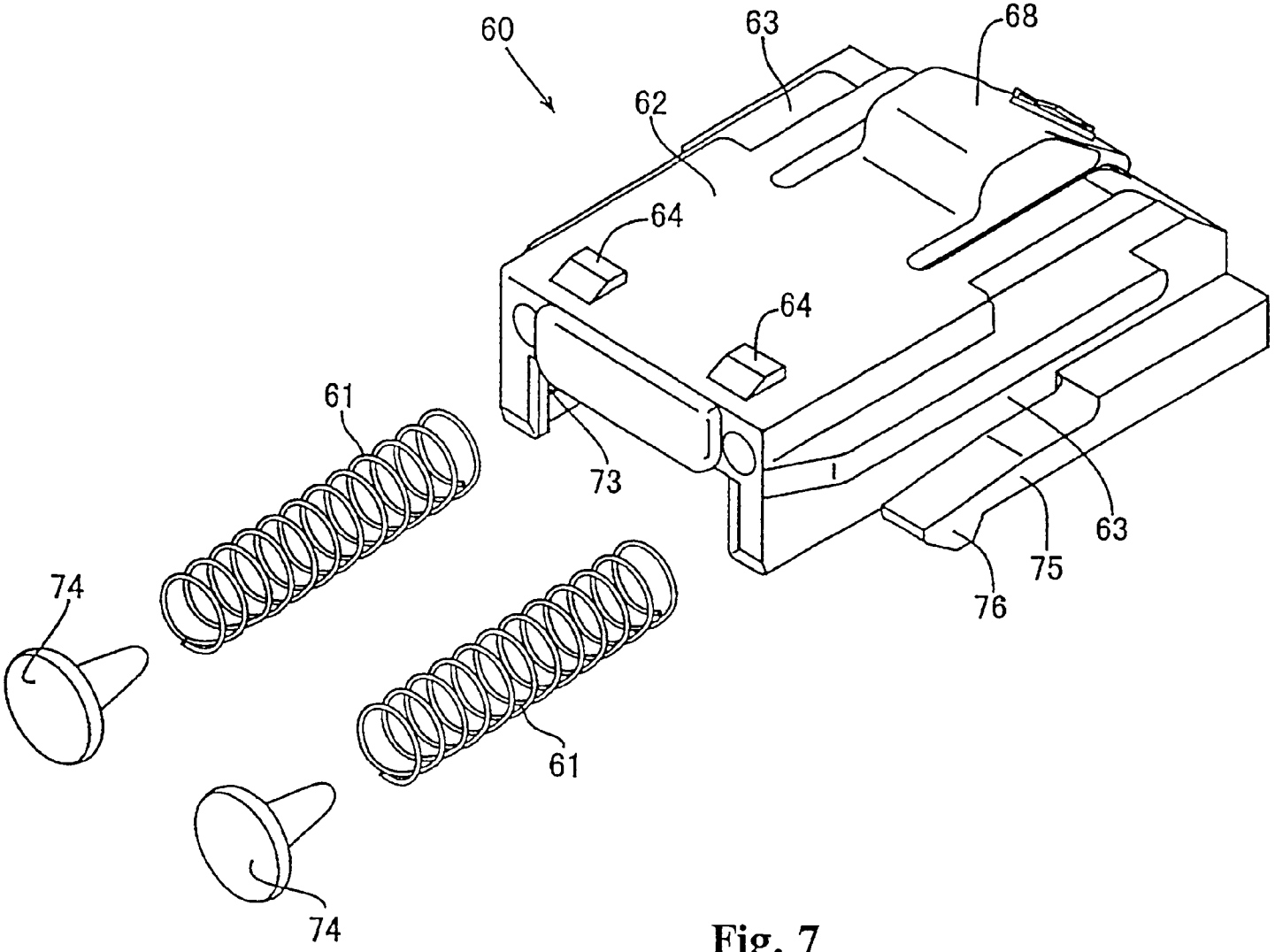
FIG. 7 is an exploded perspective view of a spring holder of the connector of FIG. 1.
Figure 8:
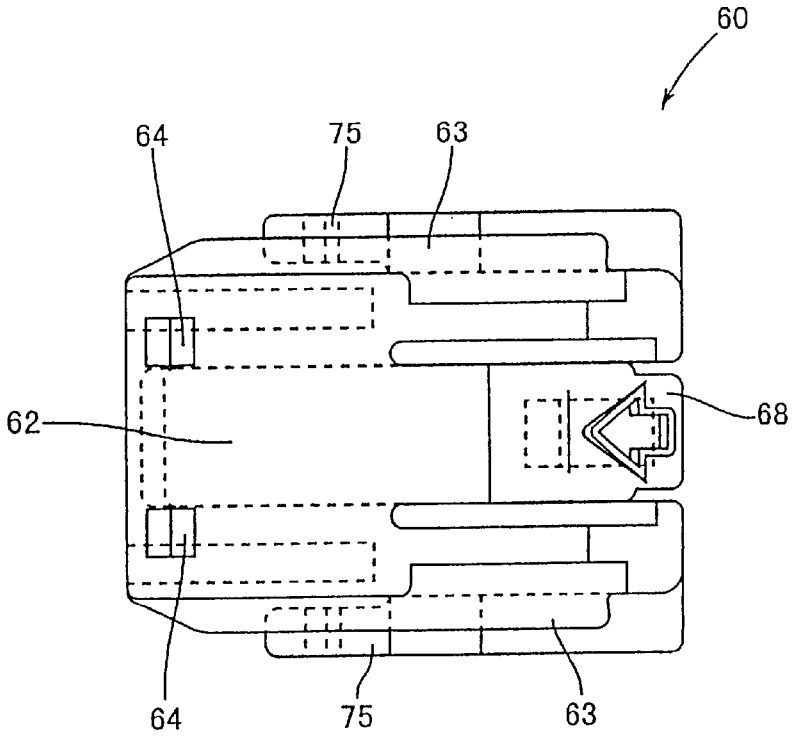
FIG. 8 is a plan view of the spring holder of FIG. 7.
Figure 9:
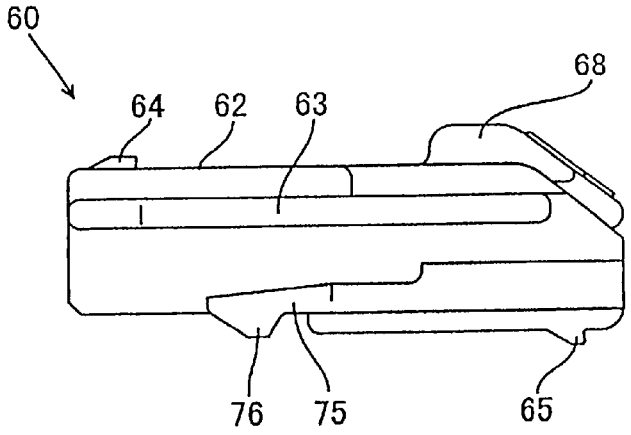
FIG. 9 is a side view of the spring holder of FIG. 7.

Each accommodation part 50 also accommodates a spring holder 60 covering the locking arm 54 (see FIGS. 7 to 9). The spring holder 60 incorporates coil springs 61 described later. The holder 60 is a separate part, inserted in the accommodation part 50. Guide rails 63 provided at right and left ends of a base portion or substrate 62 of the holder 60 are inserted into grooves 51A of side walls 51 of the accommodation part 50 such that the guide rails 63 are slidable longitudinally (see FIG. 22). The spring holder 60 is prevented from moving forward when it strikes a front plate 52A of the arch portion 52. The spring holder 60 is prevented from moving rearward when a pair of projections 64 and another pair of projections 65 formed on the upper and lower surfaces thereof respectively, are locked to locking portions 66 and 67 (see FIGS. 22 and 6) of longitudinally extending insertion grooves formed on the lower surface of the arch portion 52 and on the bottom surface of the accommodation part 50, respectively.

As shown in FIG. 8, the holder 60 has an operation portion 68 (lever or tab) elastically deformable due to the formation of slits at both sides thereof formed at the widthwise centre of the rear side of the holder 60. When the spring holder 60 is located at the rear position shown in FIG. 22, the operation portion 68 is located at a position immediately over the locking arm 54.

Figure 20A:
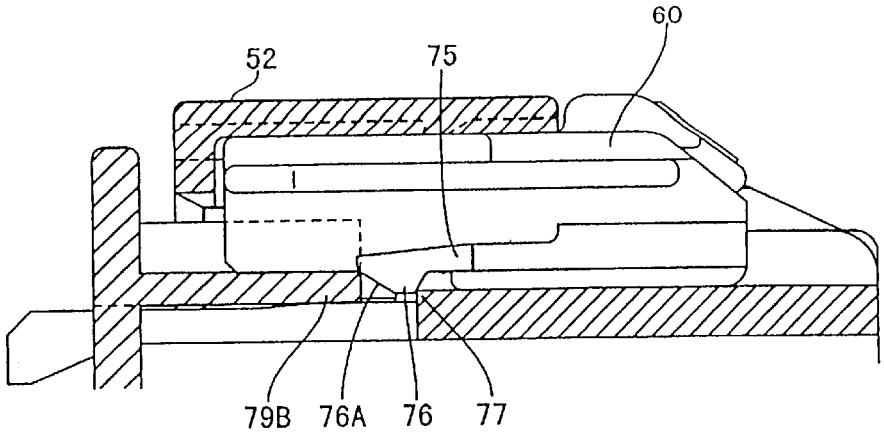
FIGS. 20A, 20B and 20C are sectional views of the state of parts of the connector of FIG. 1 immediately before the holding arm is unlocked.
Figure 20B:
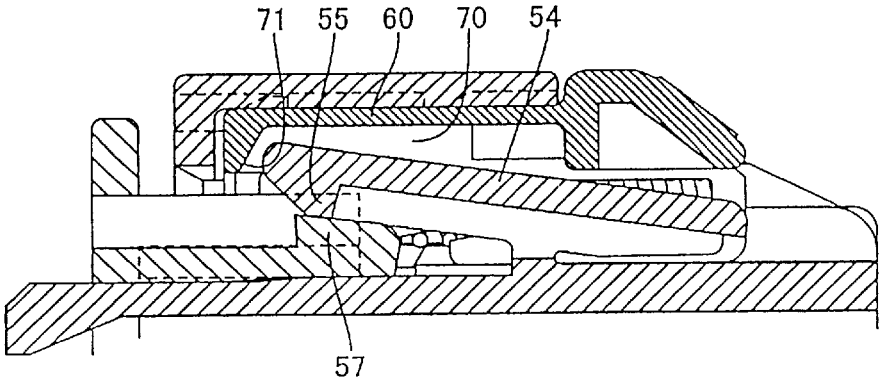
Figure 20C:
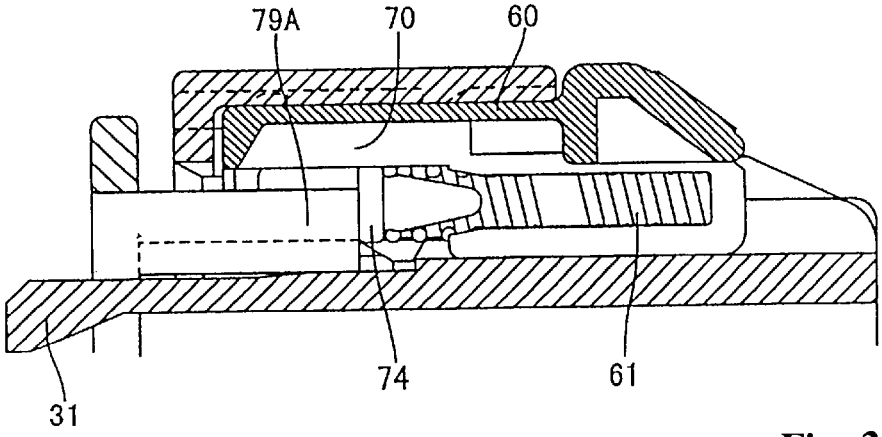

As shown in FIG. 20, a relief groove 70 is formed at the widthwise centre of the lower surface of the substrate 62. The relief groove 70 extends rearward from a position located a little rearward from the front end of the substrate 62. When the spring holder 60 is located at a front position, the front end of the relief groove 70 corresponds to the front end of the locking arm 54, thus allowing the front end of the locking arm 54 to pivot outward elastically, as shown in FIG. 20B.

The front surface of the relief groove 70 is formed as a restriction surface 71 which strikes the front end of the elastically pivoted locking arm 54, thus preventing a rearward movement of the spring holder 60.

A pair of spring accommodation chambers 73 is longitudinally formed on the lower surface of the substrate 62 of the spring holder 60 on opposite sides of the locking arm 54. Each chamber 73 accommodates the coil spring 61 in a natural state in such a manner that the coil spring 61 is prevented from moving forward. A spring seat 74 is fitted on the front end of the coil spring 61. About half of the inner side of the front surface of the chamber 73 is open. Thus, the spring seat 74 faces the opening of the front surface of the chamber 73 when the coil spring 61 is in the chamber 73.

A holding arm 75 having a hook 76 at its front end is formed integrally on the holder 60 laterally outwardly from each spring accommodation chamber 73. The holding arm 75 extends forward and is cantilevered and elastically deformable. As shown in FIG. 20A, a forward movement of the spring holder 60 is prevented when the hook 76 of the holding arm 75 is caught by a catching portion 77 formed on the bottom surface of the accommodation part 50.

As shown in FIGS. 1 to 3, a pair of L-shaped ribs 79 projects in opposite directions from both sides of each locking hook 57 of the male housing 10. The ribs 79 are capable of penetrating into the arch portion 52 from the front thereof, with the ribs 79 sandwiching the locking arm 54 therebetween when the casing 30 is fitted on the male housing 10. A horizontal leg 79A of the rib 79 shown in FIG. 3 is capable of pressing the coil spring 61 through the spring seat 74. The front end of a vertical leg 79B of the rib 79 contacts the holding arm 75, thus so deforming the hook 76 elastically that the hook 76 is unlocked from the catching portion 77.

The holding arm 75 is unlocked from the catching portion 77 immediately before the locking arm 54 returns to its original position (see FIG. 19) as a result of complete fitting of the casing 30 in the male housing 10.

The operation of the lever-type connector of this embodiment is described below.

The female terminal metal fittings are accommodated in the female housing 20 and locked by the retainers 25. When the female housing 20 is inserted into the casing 30 from the rear thereof, as shown by an arrow in FIG. 10, the locking portion 29 is locked to the locking arm 31, with the operation pin 42 of the lever 40 fitted on the start portion of the operation cam groove 45, and the casing 30 is mounted on the periphery of the female housing 20 in such a manner that the longitudinal movement thereof is prevented. At this time, the entrance 41A of the driving cam groove 41 of the lever 41 faces forward.

The male terminal metal fittings are located in the male housing 10 and locked by the retainers 15.

Figure 11:
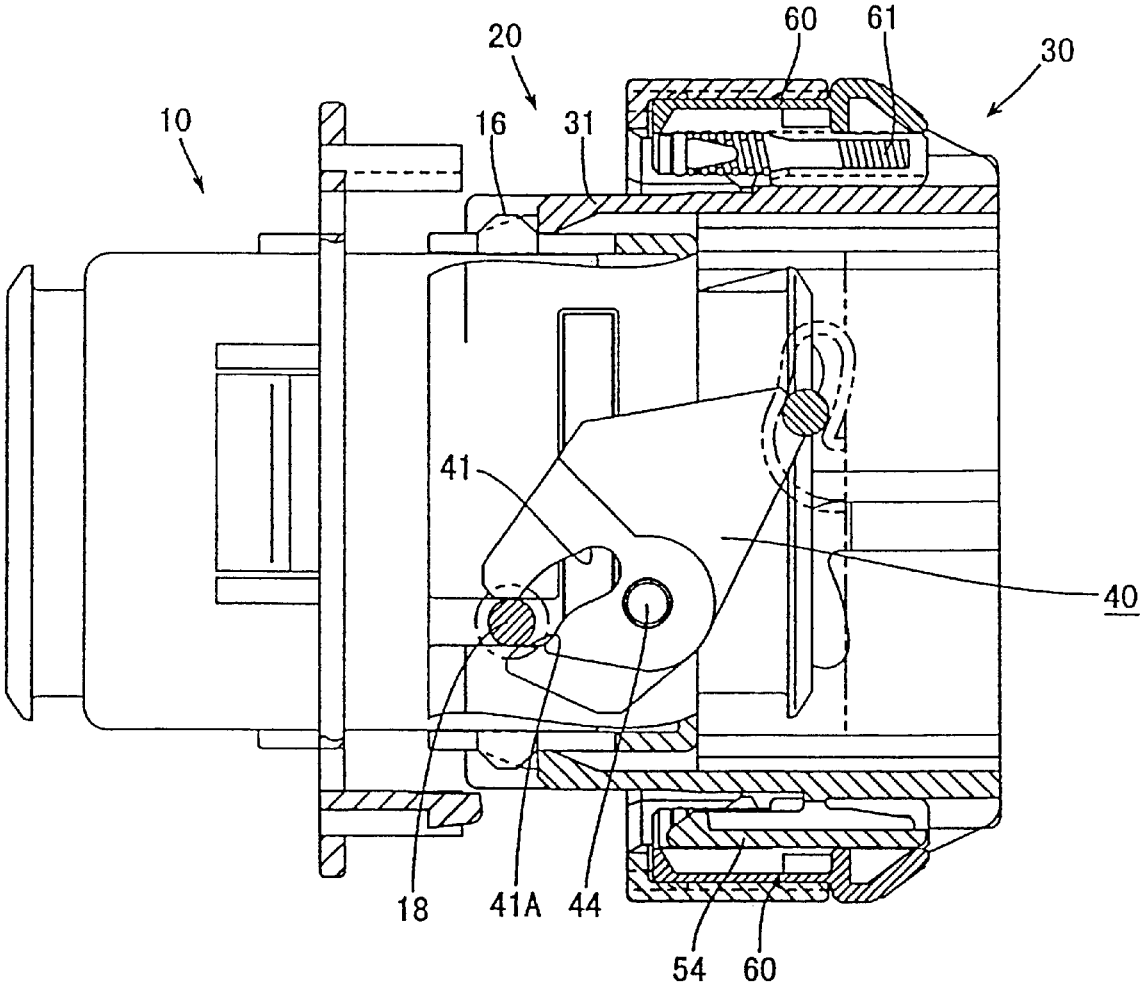
FIGS. 11 to 18 are partly cut-away plan views of the connector of FIG. 1 in successive states during the fitting operation.
Figure 12:
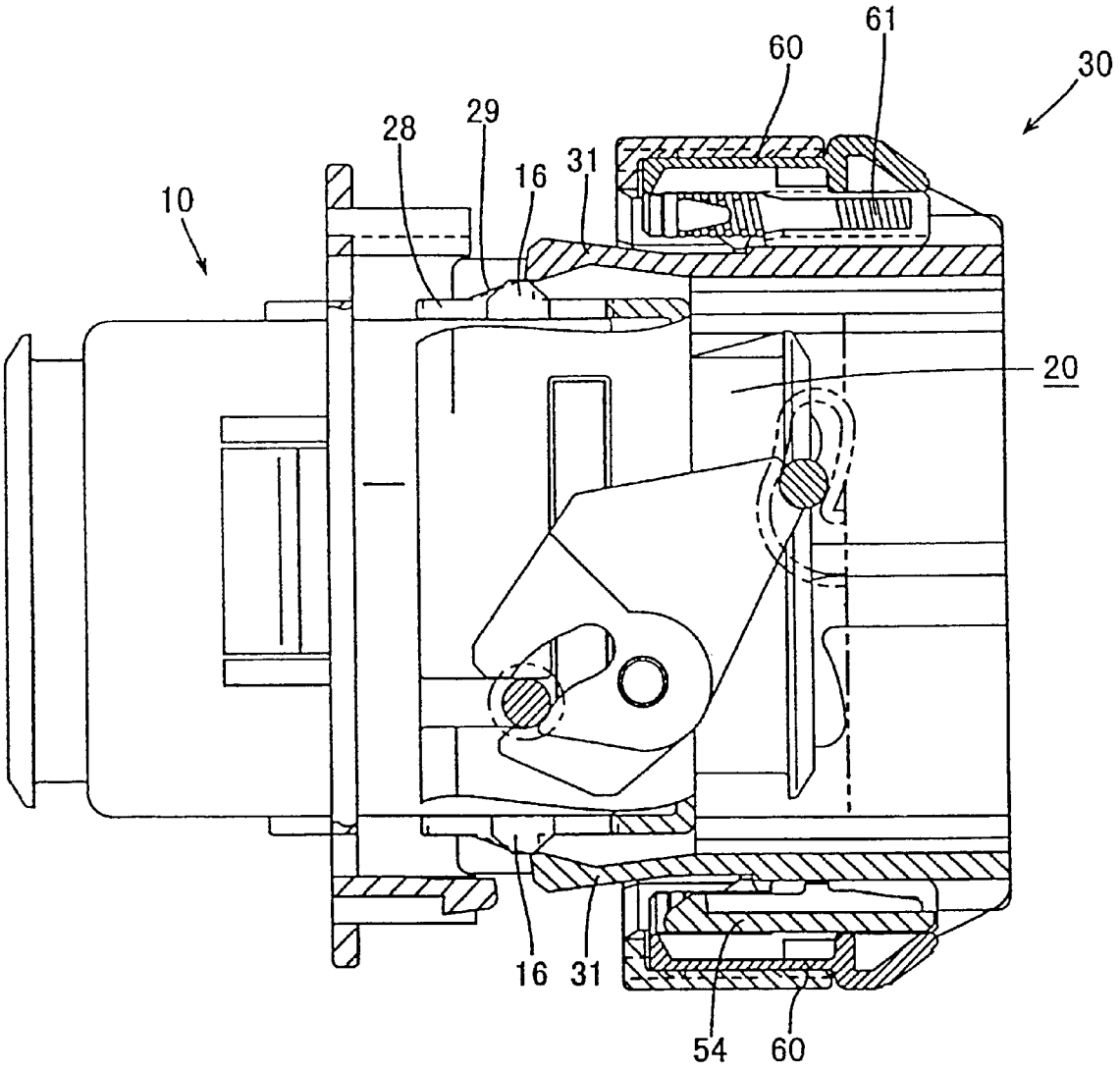

In this state, the casing 30 mounted on the female housing 20 is fitted on the outer side of the small hood part 12 of the male housing 10. As shown in FIG. 11, each follower pin 18 of the male housing 10 enters the entrance 41A of the driving cam groove 41 of the corresponding lever 40. Next, as shown in FIG. 12, the locking arm 31 rides on the release projection 16 and deforms outward elastically. As a result, the locking portion 29 is unlocked from the locking arm 31. Therefore, the female housing 20 is capable of moving rearward inside the casing 30.

Figure 13:
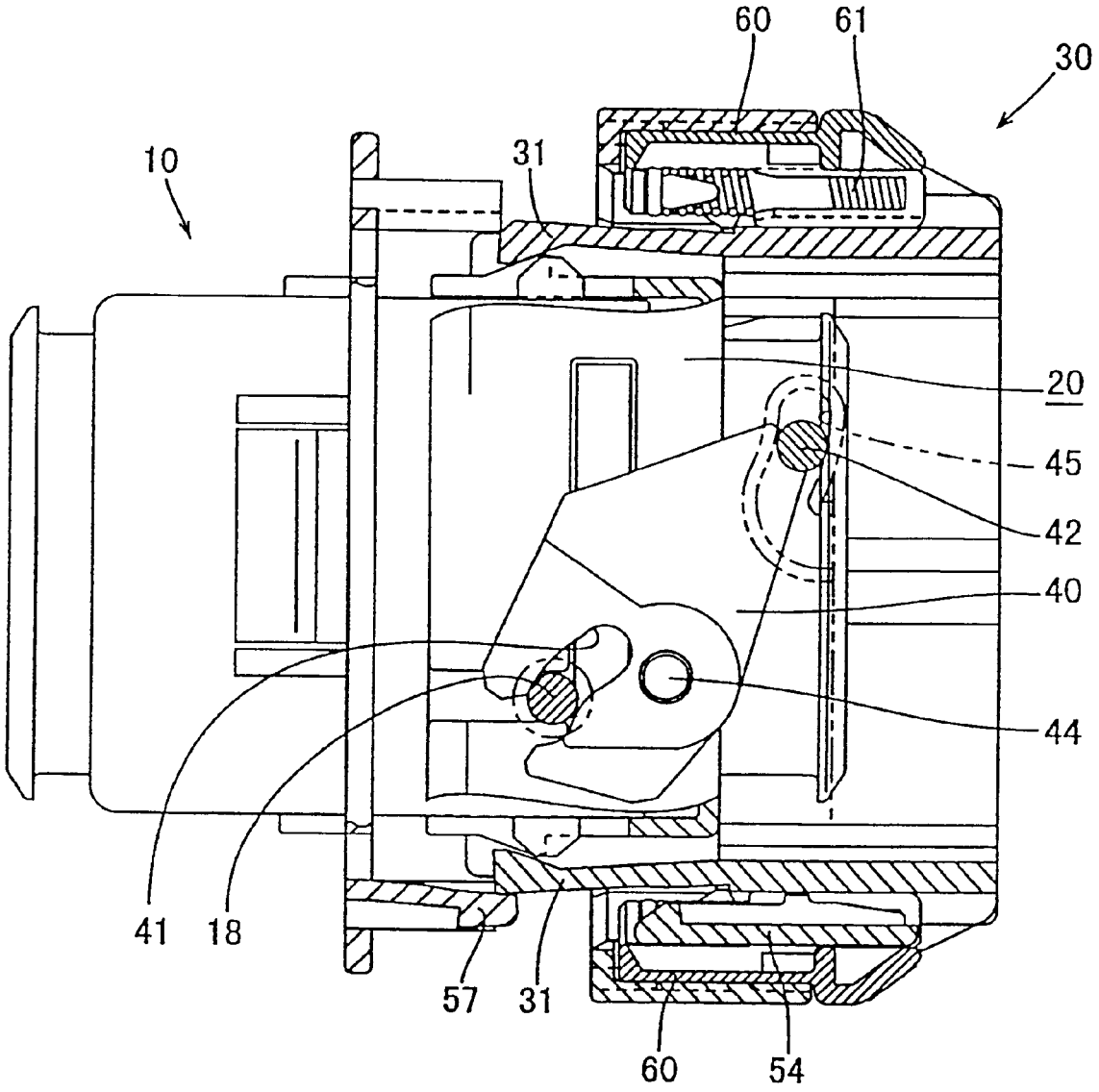

When the casing 30 is further pressed towards the male housing 10, as shown in FIG. 13, the cam groove 45 presses the operation pin 42 forward. Thus, the lever 40 is rotated counterclockwise on the shaft 44. As the follower pin 18 moves to the rear side of the driving cam groove 41, the two housings 10, 20 approach each other owing to the action of the levers. At this time, as shown in the lower side of FIG. 13, the locking arm 31 that has deformed outward elastically interferes with the locking hook 57 of the male housing 10, thus deforming the locking hook 57 outward elastically.

Figure 14:
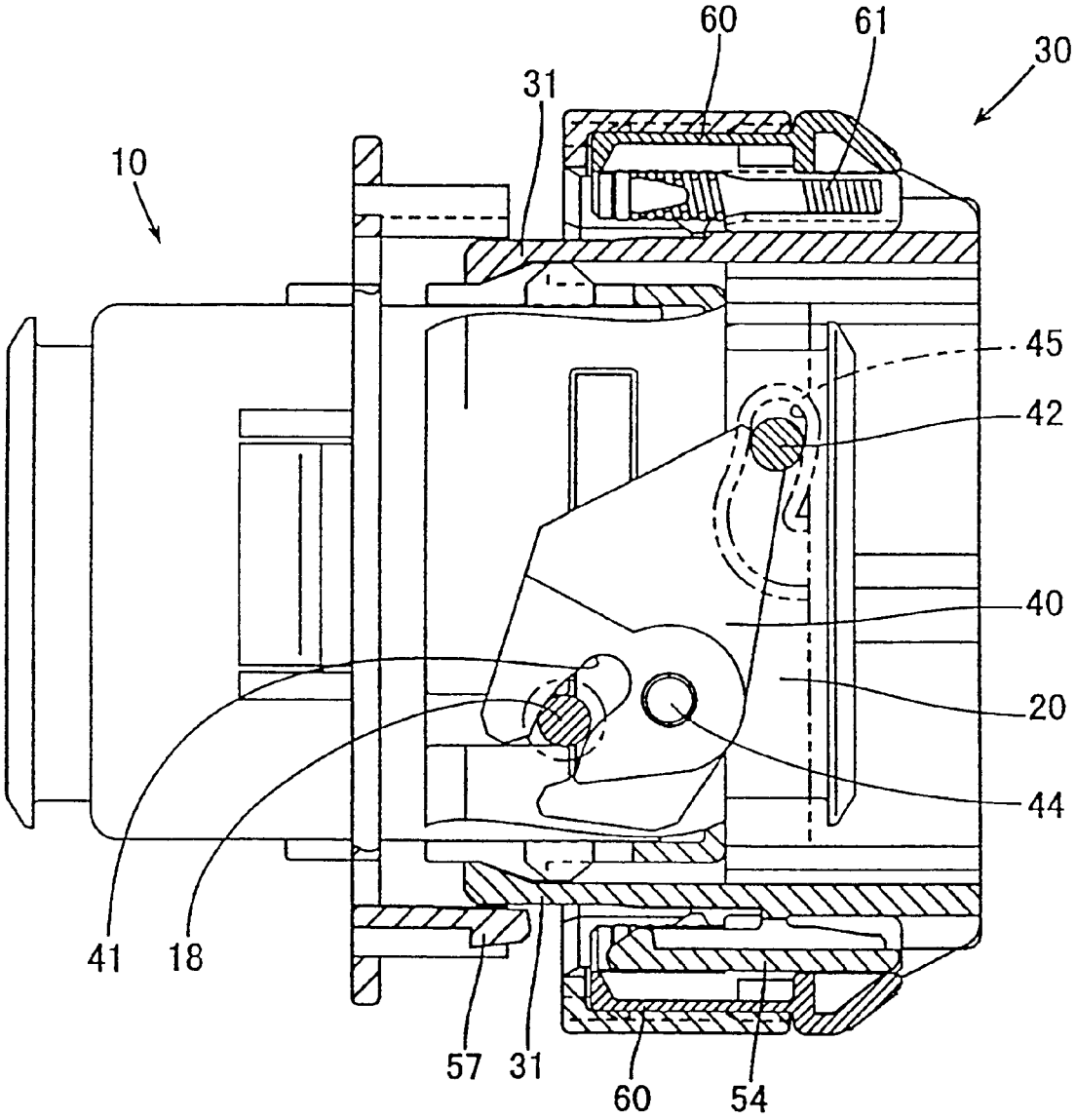
Figure 15:
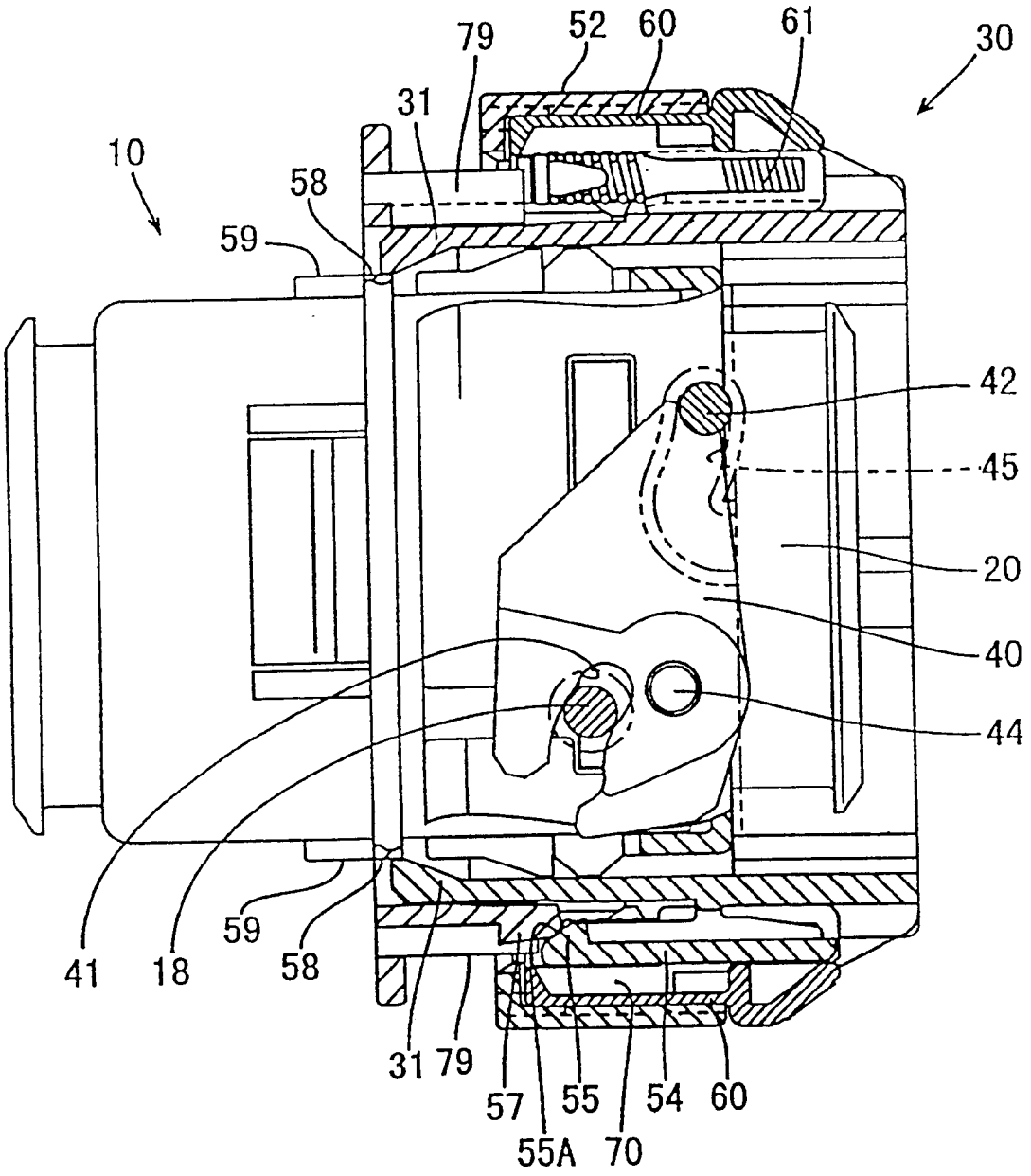
Figure 16:
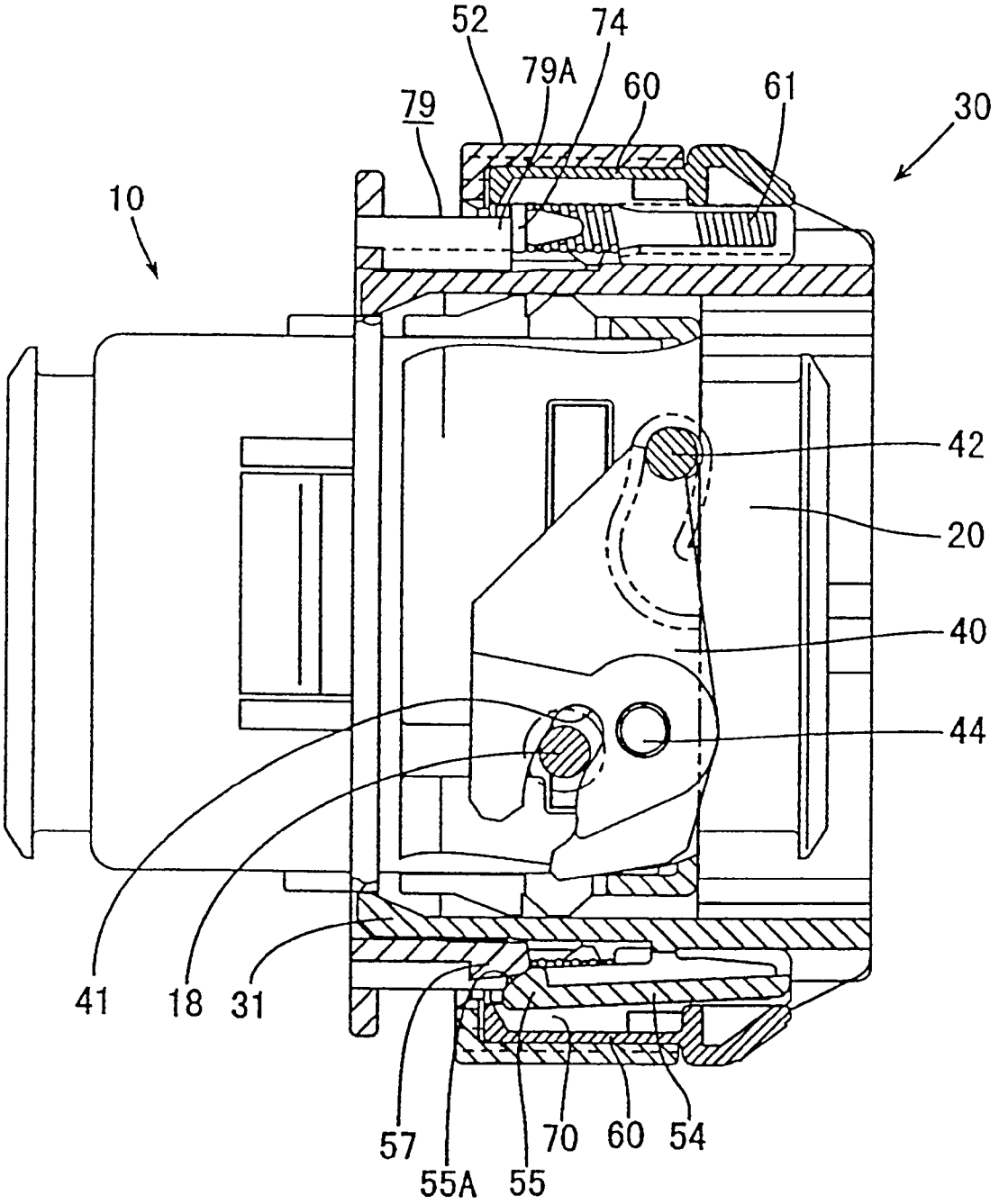

With further progress of the fitting operation, as shown in FIG. 14, with the locking arm 31 and the locking hook 57 returning to the original state, the locking arm 31 penetrates into the window hole 58 along the inner side of the locking hook 57. As a result, the inward elastic deformation of the locking arm 31 is prevented, and the inward elastic deformation of the locking hook 57 is also prevented. In this state, as shown in the lower side of FIG. 15, the locking hook 57 strikes the tapered surface 55A of the locking claw 55 of the locking arm 54. Then, as shown in FIG. 16, the locking hook 57 presses the tapered surface 55A. As a result, the locking claw 55 deforms outward elastically, penetrating into the relief groove 70 of the spring holder 60.

At this time, as shown in the upper side of FIG. 16, the rib 79 of the male housing 10 penetrates into the arch portion 52, and each horizontal portion 79A contacts the corresponding spring seat 74.

As shown in FIG. 20A, the holding arm 75 is caught by the catching portion 77, and as described above, the front end of the locking arm 54 is fitted in the relief groove 70 of the spring holder 60 and thus locked to the restriction surface 71. Therefore, the spring holder 60 is prevented from moving rearward.

Figure 17:
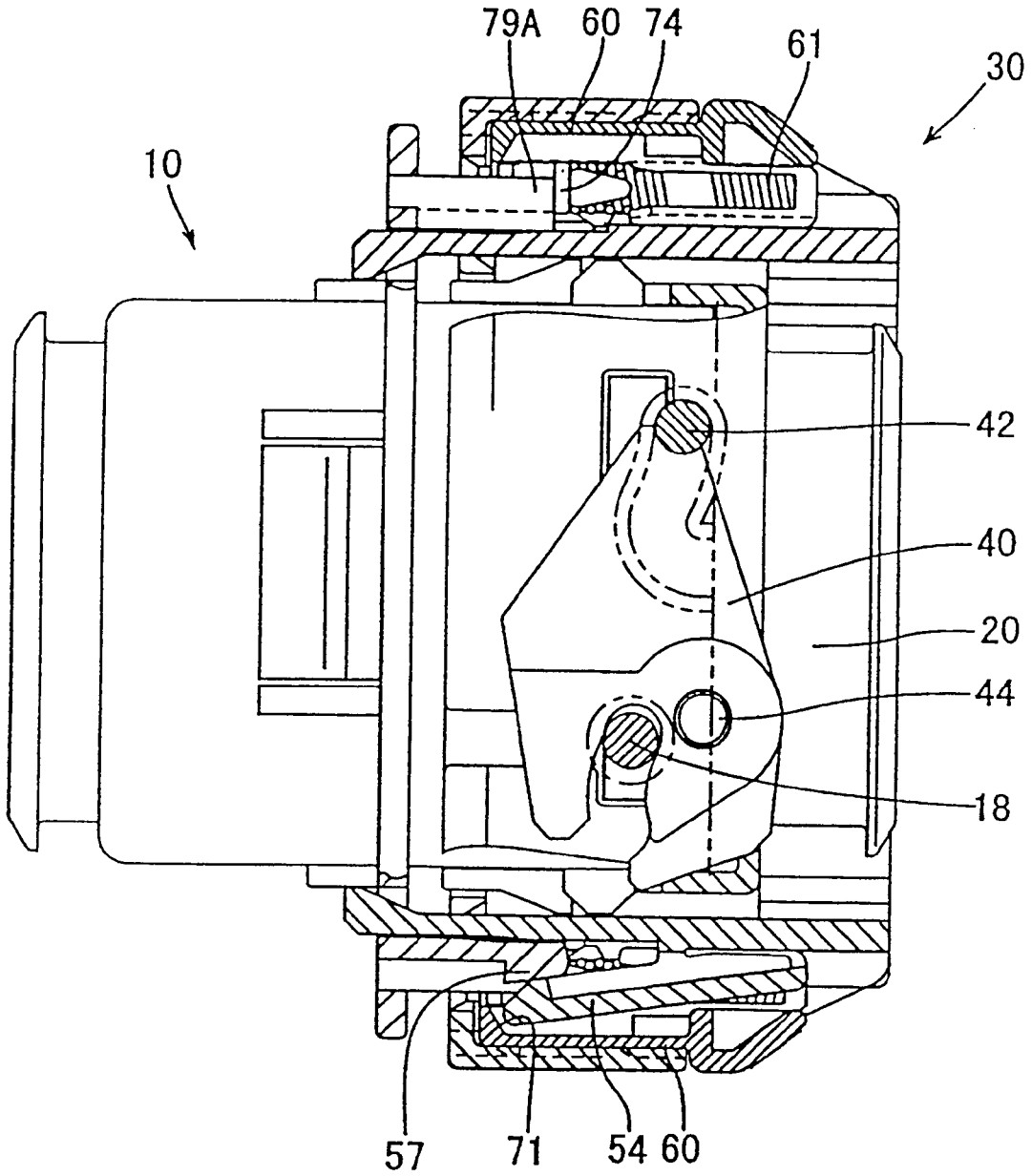

Therefore, with further penetration of the rib 79 into the arch portion 52, as shown in the upper side of FIG. 17, the coil spring 61 is gradually compressed by the spring seat 74. Meanwhile, the two housings 10, 20 are further approached to each other owing to the action of the levers.

In this state, the terminal metal fittings of both housings 10, 20 are deeply connected with each other and the fitting resistance increases. Thus, there is a possibility that the fitting operation is stopped erroneously, i.e. the housings 10, 20 may be left incompletely fitted together. In this case, the casing 30 is so urged that it moves away from the male housing 10 by the restoring elastic force of the coil springs 61. Further, the two housings 10, 20 are separated from each other by the rotation of the lever 40 in the opposite direction. Thereby, it is possible to detect that the housings 10, 20 are incompletely fitted.

Figure 18:
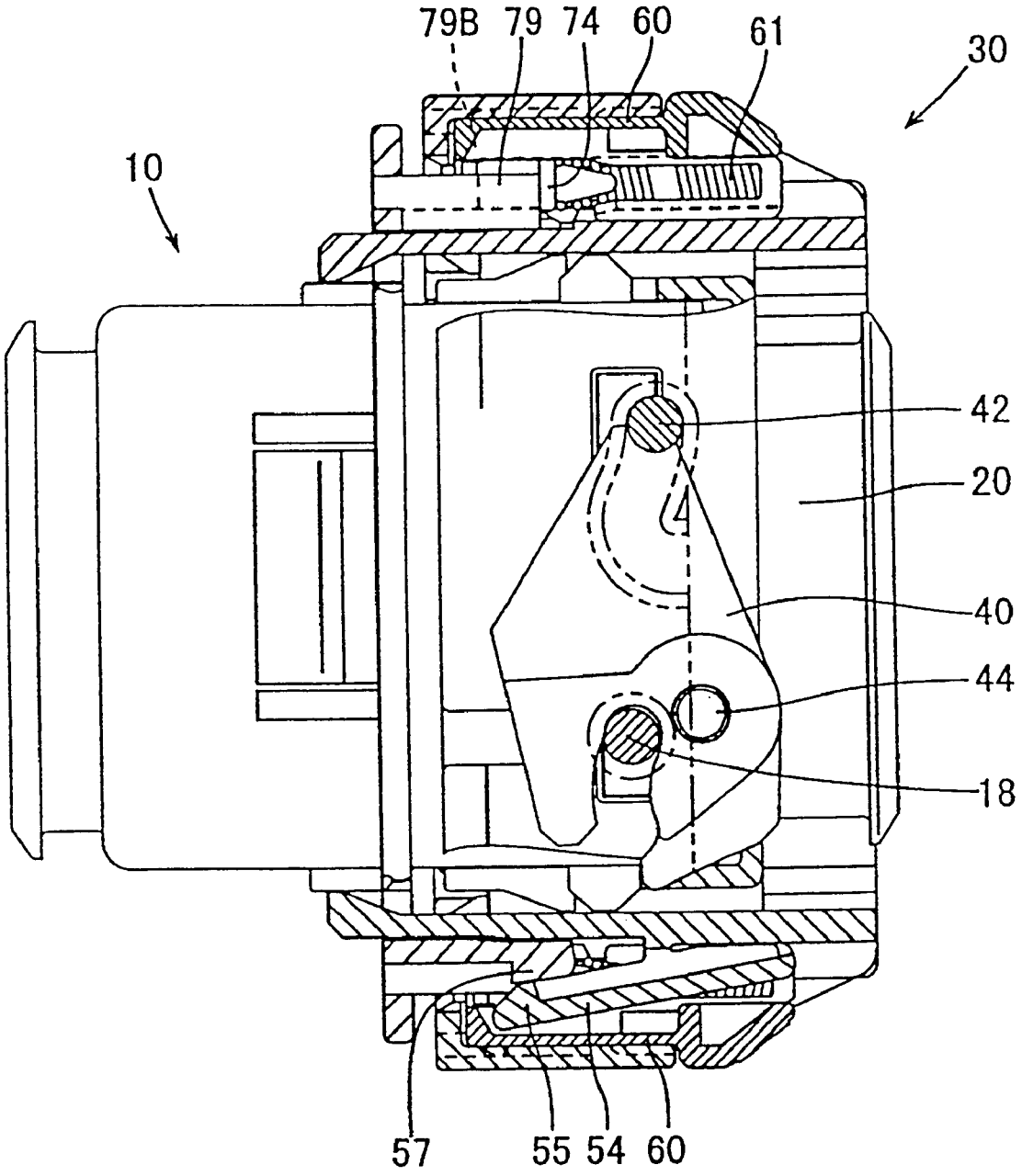
Figure 19:
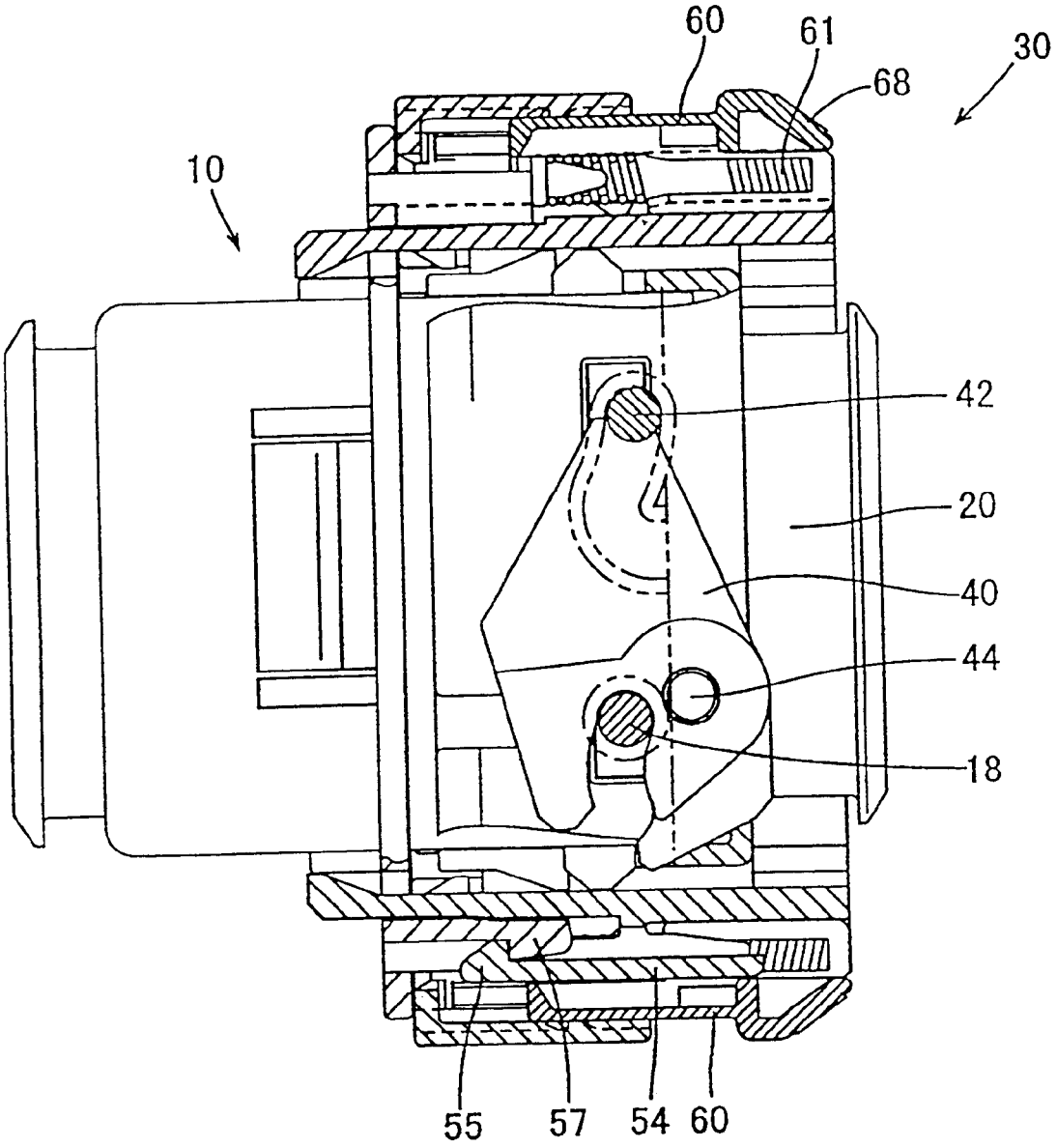
FIG. 19 is a partly cut-away plan view of the connector of FIG. 1 showing a locked state at completion of fitting.
Figure 21A:
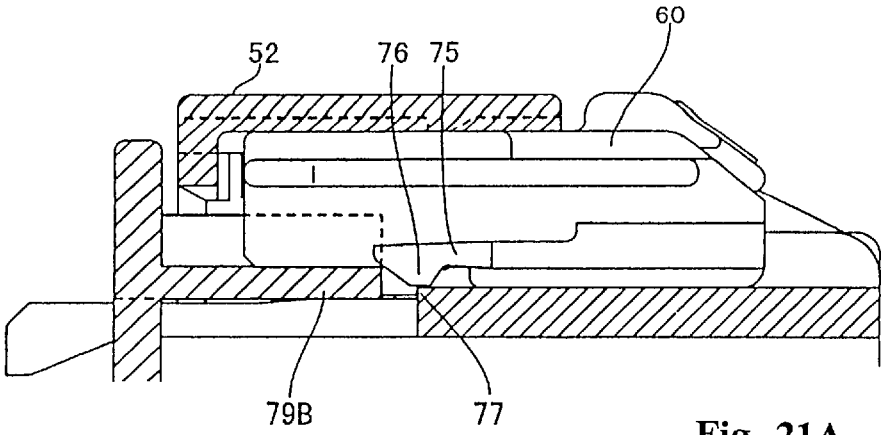
FIGS. 21A, 21B and 21C are sectional views of the state of parts of the connector of FIG. 1 immediately before locking.
Figure 21B:
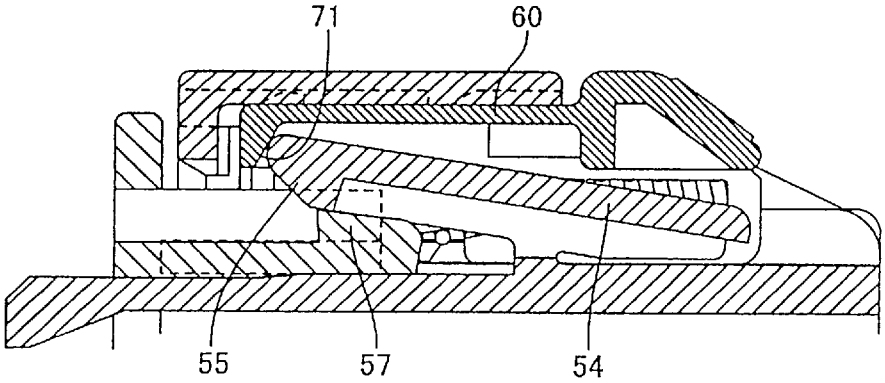
Figure 21C:
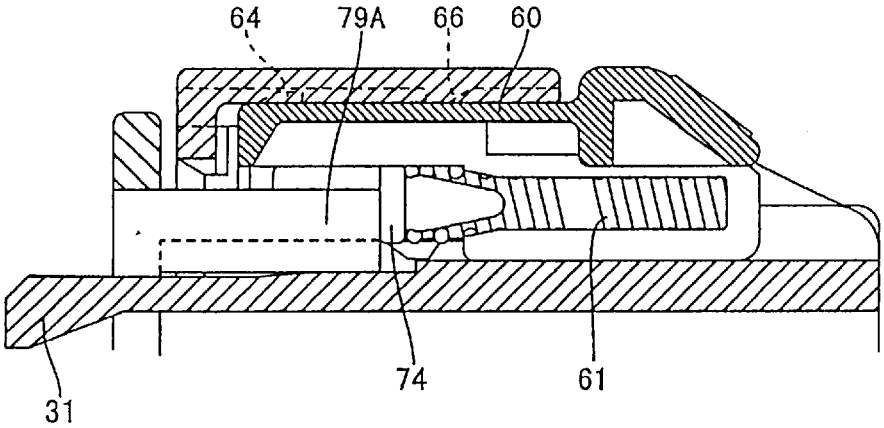

Immediately before the locking claw 55 rides over the locking hook 57 as a result of continuation of the fit-in operation as shown in FIG. 18, the vertical portion 79B of the rib 79 proceeds to a position immediately before the holding arm 75 and strikes the tapered surface 76A of the hook 76, as shown in FIG. 20A. Then, as shown in FIG. 21A, the holding arm 75 continues to deform elastically and is released from the catching portion 77. At this time, as shown in FIG. 21B, the restriction surface 71 contacts the locking claw 55 which is still deformed elastically. Therefore, the spring holder 60 is prevented from moving rearward, although the elastic restoring force of the coil spring 61 is applied to the spring holder 60.

With further progress of the fitting operation, the locking claw 55 of the locking arm 54 rides across the hook 57 and is locked to the rear surface of the hook 57 by returning to its original state. Now, the housings 10, 20 are fitted in each other normally, and the casing 30 and the male housing 10 are locked to each other.

Further, the locking claw 55 is unlocked from the restriction surface 71 by the above locking operation. Thus, the restoring elastic force of the coil spring 61 causes the spring holder 60 to move to the retreat position and the coil spring 61 returns to its natural state. See FIG. 22.

Figure 22A:
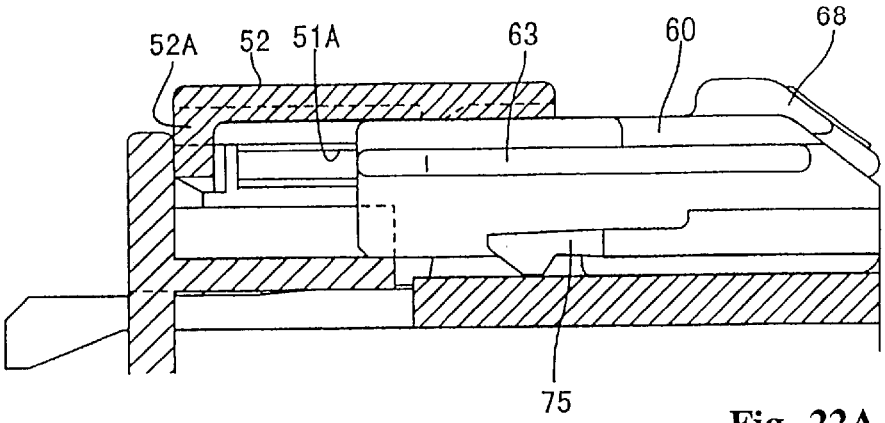
FIGS. 22A, 22B and 22C are sectional views of parts of the connector of FIG. 1 in the locked state.
Figure 22B:
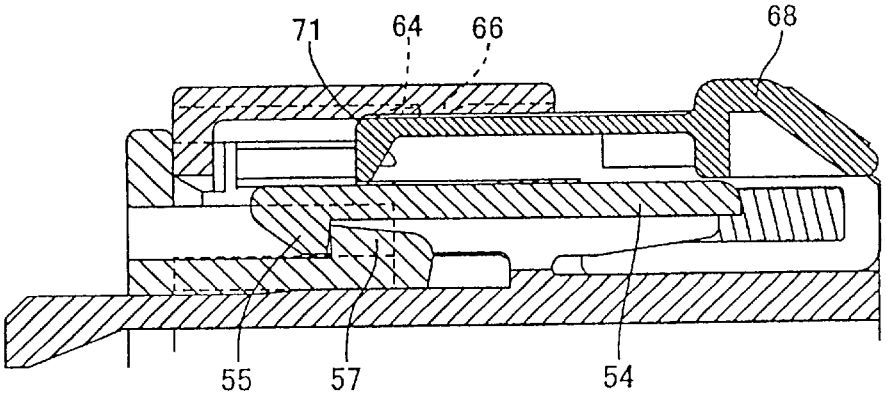
Figure 22C:
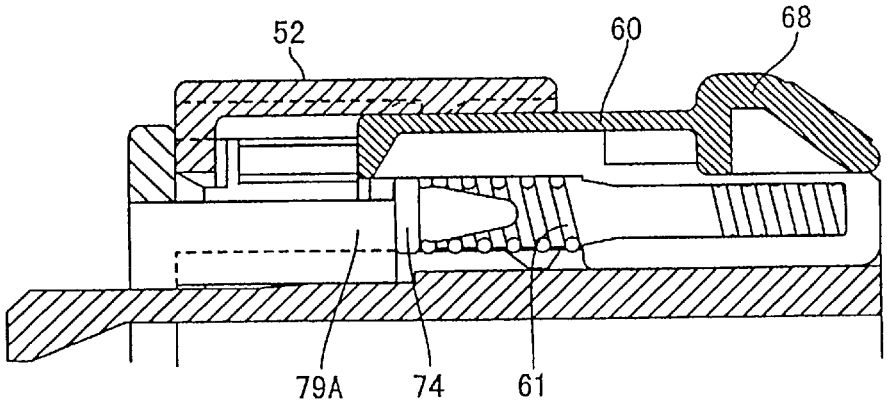

To unlock the housings 10 and 20 from each other, the operation portion 68 is pressed forward in the state shown in FIG. 22 to move the spring holder 60 to the forward position, and is pressed downward to deform elastically. As a result, the rear side of the locking arm 54 is pressed and the locking claw 55 so deforms that it moves into the relief groove 70 of the spring holder 60. Thereby, the hook 57 is unlocked from the locking claw 55, and the rib 79 of the male housing 10 is pressed downward by the force of the coil springs 61 stored by the pressing of the spring holder 60. Consequently, the separation of the casing 30 from the male housing 10, namely separation of the male housing 10 from the female housing, is accomplished.

As is apparent from the foregoing description, in this embodiment, when the fitting operation is stopped before the housings 10, 20 are fitted in each other normally, the urging force of the coil spring 61 causes the male housing 10, the casing 30, and the female housing 20 to separate from each other. This allows an operator to securely detect whether the housings 10, 20 have been fitted in each other normally.

When the housings 10, 20 are fitted in each other normally and locked to each other, the restraint of the spring holder 60 is released, and the compression state of the coil springs 61 is released, so that the spring holder 60 is moved rearward. That is, when the housings 10, 20 are fitted in each other normally, the spring force does not act to separate the housings 10, 20 from each other.

The construction of the lever-type connector is that the casing 30 serving as the operation portion of the lever 40 is provided for the female housing 20 and the return coil spring 61 is provided between the casing 30 and the male housing 10. A small spring force is amplified by the lever 40 to such a high extent as to separate both housings 10 and 20 from each other. That is, it is possible to select a small spring force.

The present invention is not limited to the embodiment explained above. For example, the following embodiments are included in the technical scope of the present invention. Further, various modifications can be made without departing from the spirit and scope of the present invention.

(1) The locking mechanism and the spring mechanism may be provided on only one surface.

On the other hand, if the connector is widthwise long and narrow, it is preferable to provide the connector housings with the locking mechanism and the spring mechanism at both sides in the longitudinal direction thereof.

That is, when the connector housings are long and narrow, there is a fear that they are locked to each other, with the longitudinal ends dislocated forward or rearward and inclining upward or downward. As a result, the front ends or the rear ends of the connector housings that has been dislocated rearward may not be fitted normally on each other.

According to the lever-type connector of the present invention, because the locking mechanism and the spring mechanism are provided at both sides of the connector housings in the longitudinal direction thereof, it is possible to lock the connector housings to each other when both longitudinal ends thereof are normally fitted in each other. Thus, both connector housings can be held in the normal fit-in state in the whole region of the longitudinal direction thereof.

(2) In the above-described embodiment, the coil spring has been described as an example of the return spring. But other kind of spring such as a leaf spring may be used.

(3) The spring holder and the locking arm may be set on the male housing.

(4) The present invention is applicable to a type of a connector having the lever provided exposed to the outside as well as to the type of connector incorporating the lever interiorly.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

What is claimed is:

1. A lever-type electrical connector, comprising:

first and second connector housings adapted to be detachably fitted together in a connected position by relative movement in a fitting direction, a lever rotatably mounted on said connector for drawing said connector housings in said fitting direction towards said connected position, locking means provided on said connector housings for locking them together in said connected position, and spring means provided to act operatively between said connector housings so as to be resiliently deformed when said connector housings are being moved towards said connected position, thereby to create a force urging said connector housings in their separation direction at least during the movement of said connector housings towards said connected position, wherein said spring means comprises at least one spring having a front end and a rear end, said first connector housing acting upon said front end of said spring to compress said spring during fitting of said connector housings together, and said second connector housing has a spring holder restraining said rear end of said spring, said spring holder being arranged to cooperate with said locking means so that, during fitting of the connector housings together, (i) before said locking means locks said connector housings in said connected position said spring holder restrains said spring from relaxation of its compressed state, and (ii) when said locking means has locked said connector housings in said connected position said locking means releases the restraint of said spring thereby allowing at least partial relaxation of said spring.

2. A connector according to claim 1, wherein said locking means comprises cooperating members in the form of at least one locking projection provided on said first connector housing and correspondingly at least one resiliently deformable locking arm provided on said second connector housing, said locking projection and locking arm being arranged and shaped so that, when said connector housings are moved towards said connected position, said locking arm engages and is deflected by said locking projection and thereafter locks behind said locking projection in a latch manner, said locking arm when so deflected preventing said spring holder from release of the compressed state of said spring.

3. A lever-type connector according to claim 1, wherein said spring holder is displaceable on said second connector housing in said fitting direction, to compress and relax said spring.

4. A lever-type connector according to claim 1, wherein both said connector housings are elongate with their elongation direction extending transversely to said fitting direction, each said connector housing has a plurality of cavities for receiving electrical terminals arranged in at least one row extending in said elongation direction, said locking means acts to lock said connector housings together at both ends of said connector housings in said elongation direction and said spring means comprises springs acting on said connector housings at both ends of said connector housings in said elongation direction.

5. A lever-type connector according to claim 1, wherein one of said connector housings comprises a housing portion adapted to receive electrical terminals and a casing which receives said housing portion, said housing portion being slidable in said casing in said fitting direction, said lever is rotatably mounted on said housing portion and has a cam surface, the other of said connector housings has a cam follower which engages said cam surface during fitting of the connector housings together, said casing is engageable with said lever so that by its rotation said lever holds said casing and said housing portion together, said locking means and said spring means are provided on, and act between, said casing and said other connector housing.

* * * * *